US005924582A

United States Patent [19]

Miyata et al.

[11] Patent Number: 5,924,582

[45] Date of Patent: Jul. 20, 1999

[54] LOWERING COLLISION AVOIDANCE DEVICE OF CRANE

[75] Inventors: Noriaki Miyata; Toshio Taguchi; Masanori Masumoto, all of Hiroshima, Japan

[73] Assignee: Mitsubishi Heavy Industries, Ltd., Japan

[21] Appl. No.: 08/984,089

[22] Filed: Dec. 3, 1997

Related U.S. Application Data

[30] Foreign Application Priority Data

Dec. 6, 1996 [JP] Japan ..... 8-326576

[51] Int. Cl.[6] ..... B66C 13/06

[52] U.S. Cl. ..... 212/270; 212/273

[58] Field of Search ..... 212/270, 271, 212/272, 273, 275, 276, 286

[56] References Cited

U.S. PATENT DOCUMENTS 4,172,685 10/1979 Nabeshima et al. ..... 212/276
5,048,703 9/1991 Tax et al. .

FOREIGN PATENT DOCUMENTS 0596330 5/1994 European Pat. Off. .
29510031 12/1995 Germany .
2295596 6/1996 United Kingdom .

OTHER PUBLICATIONS

Automated All–Weather Cargo Transfer System (AACTS) report by August Design and Development, Inc., chapter IV, May 1987.

*Primary Examiner*—Thomas J. Brahan
*Attorney, Agent, or Firm*—Rothwell, Figg, Ernst & Kurz, p.c.

[57] ABSTRACT

A lowering collision avoidance device includes a container detector, a rope winding speed detector, a rangefinder for detecting the distance to an adjacent container, a rope length detector, and a controller which controls a hoisting/lowering drive motor, thereby controlling the lowering speed, in such a manner that when the container detector becomes ON, a lowering stop action is performed to start decreasing the lowering speed at a predetermined rate; even during this period, the remaining lowering distance and a normal stopping distance are computed; and when the container detector becomes OFF for one period of swing computed from the rope length detected by the rope length detector, and after a judgment is made that the risk of collision of a lowered container with the adjacent container has vanished, lowering is resumed if the remaining lowering distance is larger than the normal stopping distance, or an emergency stop action is performed if the remaining lowering distance is not larger than the normal stopping distance. Thus, the container can be lowered rapidly to a place where obstacles such as containers stacked in layers are located, with the collision of the container with the obstacle being prevented.

13 Claims, 7 Drawing Sheets

LOWERING COLLISION AVOIDANCE DEVICE OF CRANE

BACKGROUND OF THE INVENTION

This invention relates to a lowering collision avoidance device of a crane. More particularly, the invention concerns the device useful when applied to a container handling crane to be installed in a container yard such as a port yard.

In a container yard such as a port yard, containers transported there by a chassis, an automated guided vehicle (AGV) or the like are handled, one by one, by a container handling crane installed in the container yard so as to be stacked in layers (on other containers) or placed on the floor (lowered onto the ground) in the container yard.

FIG. 7 is an explanation drawing showing the constitution of a conventional container handling crane. As illustrated in this drawing, the container handling crane has a structure comprising a girder 1 provided horizontally above a container yard, legs 2 supporting the girder 1, and running systems 3 provided at the lower ends of the legs 2, as well as a trolley 4 mounted on the girder 1 and running along the girder 1, a hoisting/lowering device 5 mounted on the trolley 4, a hoisting/lowering drive motor 25 for driving the hoisting/lowering device 5, a rope 6 taken up or paid out by the hoisting/lowering device 5, a hoisting accessory 10 suspended from the hoisting/lowering device 5 via the rope 6, and a drive controller (not shown)

In placing a container 11, for example, at a target position 12 (on a container 21) between adjacent containers 22 and 23 stacked high in layers, the container handling crane acts as follows:

When a chassis or AGV 30 bearing the container 11 stops beside the container handling crane, the trolley 4 is moved along the girder 1 and halted directly above the chassis or AGV 30.

Then, the hoisting/lowering device 5 is driven by the hoisting/lowering drive motor 25 to pay out the rope 6, thereby placing the hoisting accessory 10 on the container 11. The container 11 is held by a twist lock mechanism (not shown), and the rope 6 is taken up by the hoisting/lowering device 5 to lift (hoist) the container 11 together with the hoisting accessory 10.

After or simultaneously with hoisting the container 11, the trolley 4 is moved along the girder 4. After or simultaneously with moving the trolley 4, the rope 6 is paid out by the hoisting/lowering device 5 to move down (lower) the container 11 along with the hoisting accessory 10 and bring it to the target position 12.

In other words, when the container 11 is to be carried to the target position 12, the container 11 is hoisted once to a higher position in order to escape a stack of containers lying in the way. During or after this hoisting, the trolley 4 is moved to a targeted position above the container 21. While or after moving the trolley 4, the container 11 is lowered to be put to the target position 12.

During the foregoing process, the container 11 is suspended by the rope 6, and so moves while swinging horizontally under the influence of the wind or changes in the speed of the trolley 4. To reduce the amount of swing of the container 11, various ideas have been incorporated, such as the provision of an auxiliary rope or the use of a method for automatically controlling the acceleration of the trolley 4. However, as long as the container 11 is suspended by the rope 6, it is impossible, in principle, to eliminate the swing of the container 11 completely. Particularly in a strong wind, its swing is marked.

Thus, when the container 11 is to be lowered to a place where the containers 22, 23 are stacked high in layers in adjacent rows as shown in FIG. 7 (i.e., to the target position 12), there is a possibility that the container 11, while being lowered, will collide with a container in the adjacent row particularly when a strong wind is blowing. A collision, if any, may cause damage to the container or its fall.

To avoid this accident, customary practice has been as follows: When lowering a container to a place where containers are piled high in layers in adjacent rows, namely, during its intrusion into a canyon, an operator reduces the container lowering speed, and performs an operation while making sure that this container does not collide with the adjacent container. If the container swings markedly and may collide with the adjacent container, the operator terminates its lowering immediately.

This conventional method, however, posed the problem of taking time for lowering the container, making it impossible to shorten the cycle time.

SUMMARY OF THE INVENTION

The present invention has been accomplished in the light of the above-described earlier technologies. Its object is to provide a lowering collision avoidance device of a crane which can rapidly lower a carried article (e.g., a container) to a place, where there are obstacles such as carried articles stacked adjacently in layers, while preventing the collision of the article with these obstacles.

A first aspect of the invention for attaining the above object is a lowering collision avoidance device of a crane, the crane comprising a hoisting/lowering drive motor, a hoisting/lowering device driven by the hoisting/lowering drive motor, a rope taken up or paid out by the hoisting/lowering device, and a hoisting accessory suspended from the hoisting/lowering device via the rope and hoisted and lowered by the hoisting/lowering device, the crane lowering a carried article held by the hoisting accessory, together with the hoisting accessory, to a target position in a stack of other carried articles or to a floor position, the lowering collision avoidance device being adapted to prevent the collision of the carried article during lowering with obstacles such as the other carried articles stacked in layers adjacent to the target position, the lowering collision avoidance device comprising:

- an obstacle detector for detecting the presence or absence of the obstacles, the obstacle detector being mounted on the hoisting accessory or a structure such as a stacking guide mounted on the hoisting accessory;
- a speed detector for detecting the lowering speed of the carried article;
- a distance detector for detecting the distance to the upper surface of the obstacle;
- a rope length detector for detecting the length of the rope; and
- a controller for controlling the hoisting/lowering drive motor based on detection signals from the obstacle detector, the speed detector, the distance detector and the rope length detector, thereby controlling the lowering speed of the carried article, in such a manner that when the obstacle detector becomes ON, the controller enters a lowering stop action and starts decreasing the lowering speed at a predetermined rate; even during this period, the controller computes the remaining lowering distance and a normal stopping distance; and when the obstacle detector becomes OFF for a predetermined duration, and after a judgment is made that the risk of collision of the lowered carried article with the obstacle has vanished, the controller resumes lowering if the remaining lowering distance is larger than the normal stopping distance, or enters an emergency stop action if the remaining lowering distance is not larger than the normal stopping distance.

A second aspect of the invention is the lowering collision avoidance device of a crane as the first aspect of the invention wherein when the obstacle detector becomes OFF for one period of swing computed from the rope length detected by the rope length detector, the controller judges that the risk of collision of the lowered carried article with the obstacle has vanished.

Thus, the lowering collision avoidance device of a crane as the first aspect of the invention does not stop the lowering of the carried article unconditionally when the obstacle detector detects an obstacle. Instead, the lowering collision avoidance device controls the hoisting/lowering drive motor, thereby controlling the lowering speed of the carried article, in such a manner that when the obstacle detector becomes ON, a lowering stop action is performed to start decreasing the lowering speed at a predetermined rate; even during this period, the remaining lowering distance and a normal stopping distance are computed; and when the obstacle detector becomes OFF for a predetermined duration, and after a judgment is made that the risk of collision of the lowered carried article with the obstacle has vanished, lowering is resumed if the remaining lowering distance is larger than the normal stopping distance, or an emergency stop action is performed if the remaining lowering distance is not larger than the normal stopping distance. Hence, maximum continued operation can be carried out to the extent that the lowered carried article will not collide with the obstacle. In case a real risk of collision exists, the lowering of the carried article can be stopped.

According to the lowering collision avoidance device of a crane as the second aspect of the invention, when the obstacle detector becomes OFF for one period of swing computed from the rope length detected by the rope length detector, a judgment is made that the risk of collision of the lowered carried article with the obstacle has vanished. Thus, such a judgment can be made more properly.

DETAILED DESCRIPTION OF THE PREFERRED EMBODIMENTS

Figure 7:
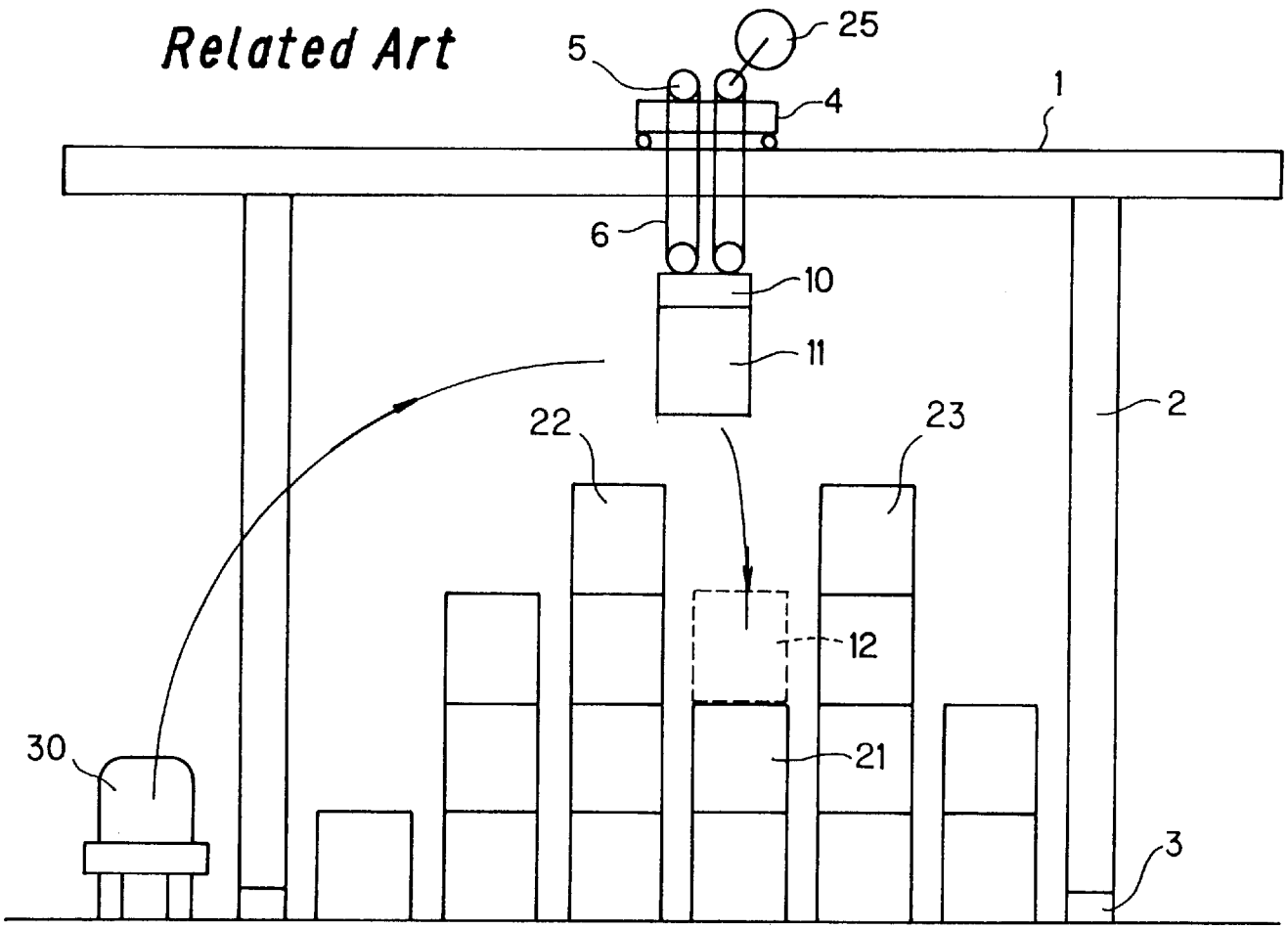
FIG. 7 Related Art
FIG. 7 is an explanation drawing showing the constitution of a conventional container handling crane.

Embodiments of the present invention will now be described in detail with reference to the accompanying drawings. The same parts as in the related art (FIG. 7) will be assigned the same numerals, and overlapping detailed descriptions will be omitted.

Figure 1:
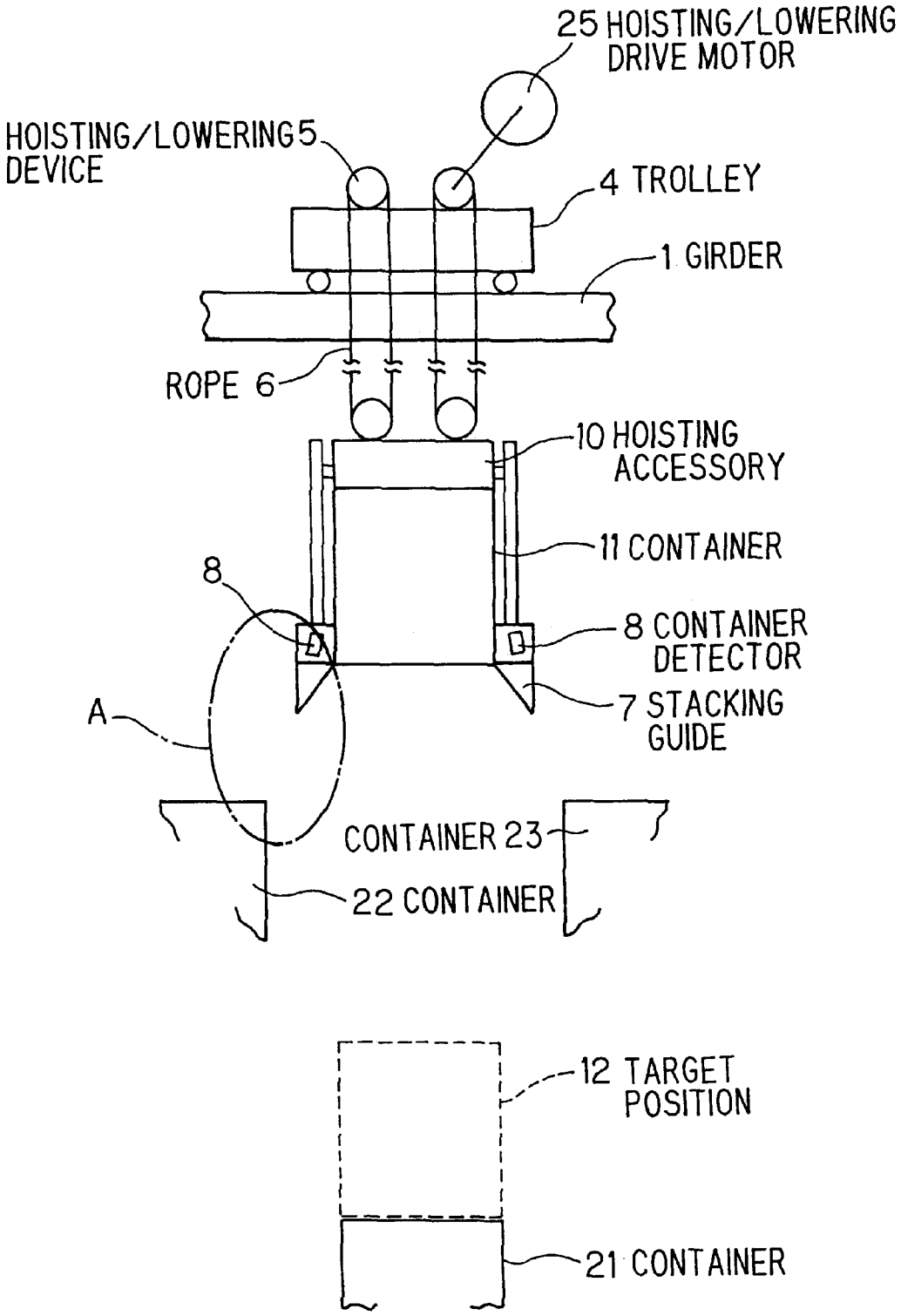
FIG. 1 is an explanation drawing showing the constitution of an essential portion of a container handling crane equipped with a lowering collision avoidance device concerned with an embodiment of the present invention.
Figure 2:
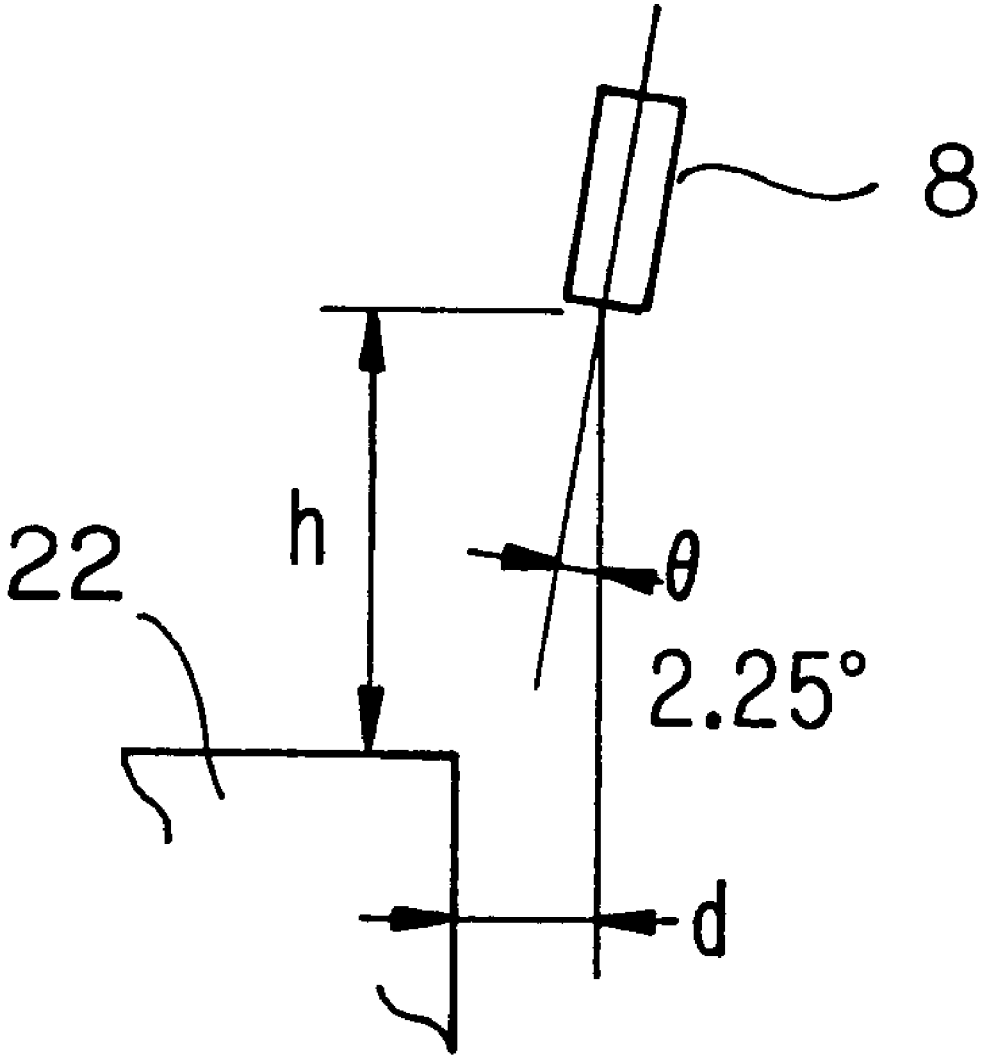
FIG. 2 is an enlarged view showing a container detector and a container extracted from the region A of FIG. 1.
Figure 3:
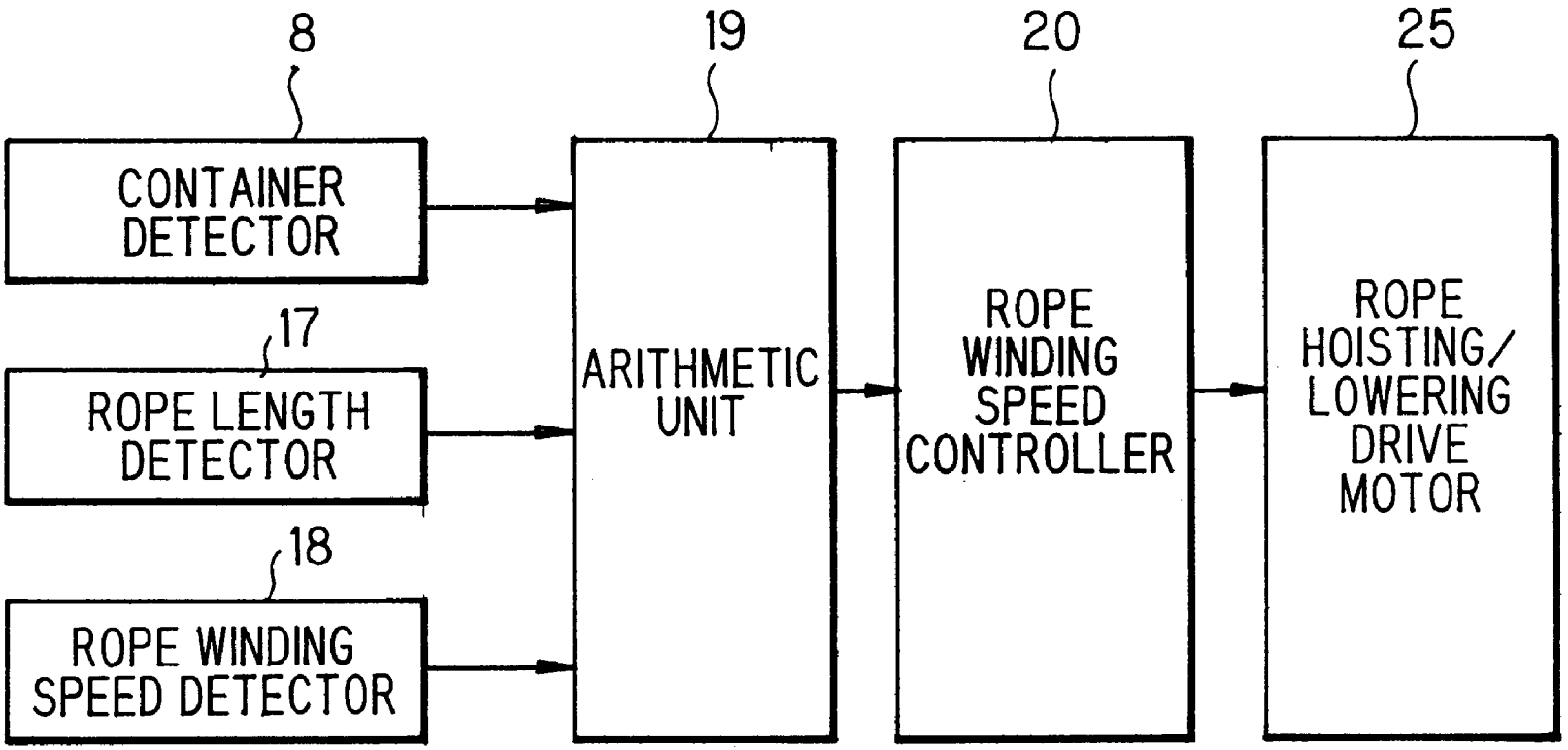
FIG. 3 is a block diagram showing the constitution of a control system relevant to the lowering collision avoidance device concerned with the embodiment of the invention.
Figure 4:
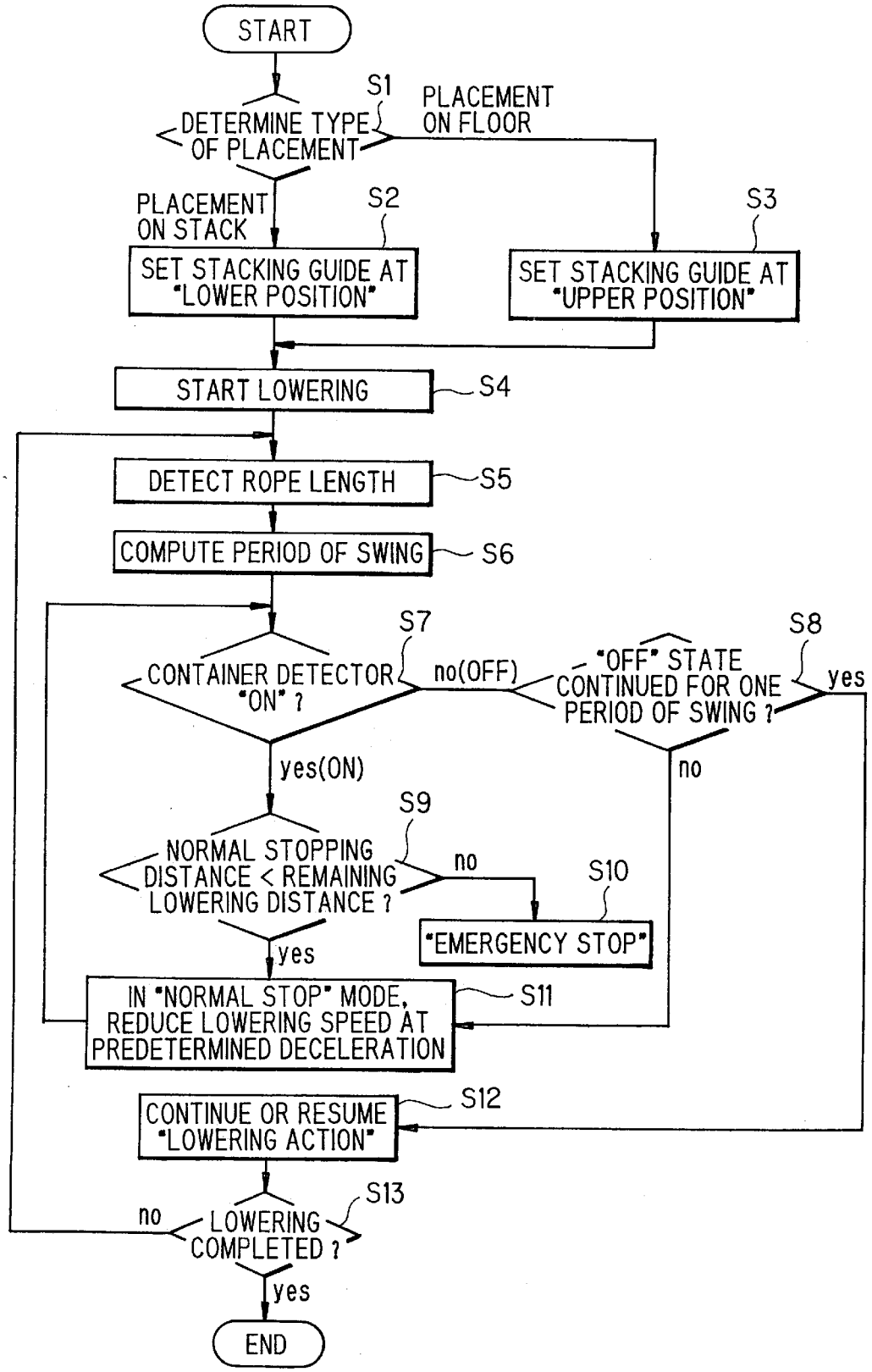
FIG. 4 is a flow chart for an operation related to the lowering collision avoidance device concerned with the embodiment of the invention.

FIG. 1 is an explanation drawing showing the constitution of an essential portion of a container handling crane equipped with a lowering collision avoidance device concerned with an embodiment of the present invention. FIG. 2 is an enlarged view showing a container detector and a container extracted from the region A of FIG. 1. FIG. 3 is a block diagram showing the constitution of a control system relevant to the lowering collision avoidance device concerned with the embodiment of the invention. FIG. 4 is a flow chart for an operation related to the lowering collision avoidance device concerned with the embodiment of the invention.

As shown in FIG. 1, a container handling crane, like a conventional container handling crane, has a structure comprising a girder 1 or the like, a trolley 4, a hoisting/lowering device 5, a hoisting/lowering drive motor 25, a rope 6, and a hoisting accessory 10.

To both ends of the hoisting accessory 10, stacking guides 7 are attached. Near the lower ends of the stacking guides 7, container detectors 8 are attached for detecting an object within several meters thereof. A total of four of the container detectors 8 are attached to the stacking guides 7 such that the lower end of each container detector 8 is inclined outward to detect an adjacent container as shown in FIG. 2.

The target of the container detector 8 is a container upper surface end about 10 mm inward of the container corner fitting. The container detector 8 is adjusted so as to detect the target when the container detector 8 lies 1,160 mm above the adjacent container.

The stacking guide 7 has such a structure as to be used while being fixed to either an upper position or a lower position of a container 11 suspended by the hoisting accessory 10. Namely, when the container 11 is to be put on containers 21 (a target position 12) already stacked in layers as shown in FIG. 1, the stacking guide 7 is fixed to a lower position of the container 11 for use as a mechanical taper guide. When the container 11 is to be placed on the floor, the stacking guide 7 is fixed to an upper position of the container 11, since the stacking guide 7 will hinder the placement of the container 11 on the floor.

As shown in FIG. 3, a detection signal from the container detector 8, a detection signal from a rope length detector 17 provided on the hoisting/lowering device 5 (see FIG. 1) and detecting the length of the rope 6, and a detection signal from a rope winding speed detector 18 provided on the hoisting/lowering device 5 and detecting the winding speed (i.e., the hoisting or lowering speed) of the rope 6 are entered in an arithmetic unit 19. Based on these detection signals, the arithmetic unit 19 does computations for controlling the winding speed of the rope 6, and issues a computational signal to a rope winding speed controller 20. The details of this action will be offered later on.

Based on the computational signal produced by the arithmetic unit 19, the rope winding speed controller 20 controls a hoisting/lowering drive motor 25 to control the winding speed of the rope 6.

Next, the method of operation by the above-described control system for placing a container on containers stacked in layers or for placing the container on the floor will be explained based on the flow chart of FIG. 4. The respective parts of FIG. 4 are assigned the symbols S1, S2, etc.

(1) For placement on a stack of containers

The stacking guide 7 is set at "a lower position" and locked to the bottom of a suspended container 11 before the container 11 comes to a position 1,170 mm above a canyon (see S1, S2).

(2) For placement on the floor

The stacking guide 7 is set at "an upper position" and locked to the hoisting accessory 10 (see S1, S3).

(3) The lowering of the container 11 is started, and the rope length is detected by the rope length detector 17 (see S4, S5). The container detector 8 is set to become effective when the distance between the lower end of the stacking guide and the adjacent container is 1,000 to 1,120 mm after the lowering is started. Also, one period of swing is calculated based on the detected rope length. When the container detector 8 becomes ON, the following process works (see S7, S8, S9, S10, S11, S12):

(a) Lowering is set in the "normal stop" mode to reduce the lowering speed at a predetermined deceleration. After the container detector 8 becomes OFF, the program waits for one period of swing calculated from the rope length. If the container detector 8 does not become ON during this wait for one period (i.e., when the OFF state has continued for one period), lowering is resumed. If the container detector 8 becomes ON during this wait for one period of swing, the "normal stop" state is maintained.

The above procedure is repeated.

(b) When "the normal stopping distance>the remaining lowering distance", an "emergency stop" is performed.

The remaining lowering distance is determined in the following manner: On the girder 1, a rangefinder (not shown) is mounted so as to be positioned directly above each stack of the containers. These rangefinders detect the distance from the girder 1 to the top of each stack of containers. The altitudinal position of the container being carried, on the other hand, is detected by the rope length detector 17. The height of one container is already known. Thus, the remaining lowering distance is calculated from detection signals for both detections.

When the container is placed on the stack of containers (or placed on the floor) to lessen the load on the hoisting accessory 10, a spring-supported rod (not shown) moves upward to turn off a limit switch (not shown) Based on this action, it is determined whether the lowering has been completed or not (see S13).

As described above, the lowering collision avoidance device related to the instant embodiment does not stop the lowering of the container 11 unconditionally when the container detector 8 detects the adjacent container. Instead, the lowering collision avoidance device controls the hoisting/lowering drive motor 25, thereby controlling the lowering speed of the container 11, in such a manner that when the container detector 8 becomes ON, a lowering stop action is performed to start decreasing the lowering speed at a predetermined rate; even during this period, the remaining lowering distance and a normal stopping distance are computed; and when the container detector 8 becomes OFF for one period of swing, and after a judgment is made that the risk of collision of the lowered container 11 with the adjacent container has vanished, lowering is resumed if the remaining lowering distance is larger than the normal stopping distance, or an emergency stop action is performed if the remaining lowering distance is not larger than the normal stopping distance. Hence, maximum continued operation can be carried out to the extent that the container 11 will not collide with the adjacent container. In case the risk of collision exists actually, the lowering of the container 11 can be stopped. Hence, the cycle time can be shortened safely.

The detection characteristics of the container detector 8 will be described. A photoelectric sensor is used as the container detector 8. This photoelectric sensor emits light by itself, and catches reflected light to judge whether an object (container) is present or not.

The detection characteristics of the container detector 8 vary with the sensitivity set, the mounting angle to the object, and the color of the object. The detection characteristics were measured, and optimum set conditions were selected. The selected condition was θ=2,25° (see FIG. 2).

Figure 5:
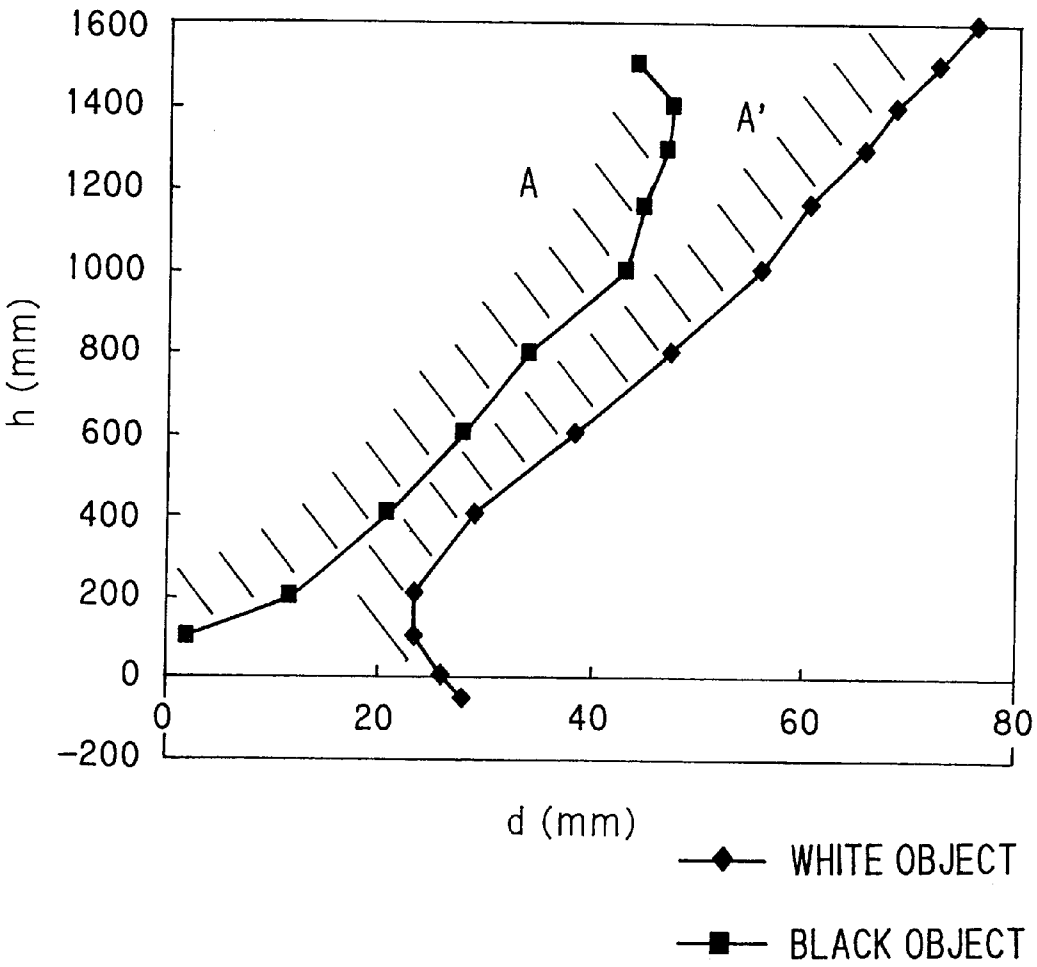
FIG. 5 is a graph showing the results of measurement of the detection characteristics of a container detector provided in the lowering collision avoidance device related to the embodiment of the invention.

FIG. 5 is a graph showing the results of measurement of the detection characteristics of the container detector under the selected condition. In FIG. 5, the plotted points (◆: a white object, ■: a black object) each show the detected distance d between the container detector 8 and the object when the height h of the container detector 8 from the object is changed (see FIG. 2). When the container detector 8 enters the region on the left of the line connecting together the measured points in FIG. 5, i.e., the region A for the black object or the region A' for the white object, the output of the container detector 8 becomes ON.

From these results of measurements, a conclusion was reached that the container detector 8 should be adjusted to detect the black object when it comes to a height of 1,160 mm (spacing 1,000 mm+the distance 160 between the container detector and the lower end of the stacking guide). This condition corresponds to the highest risk of collision. In case the object is white, the container detector 8 is to detect the edge of the object from a little more distance.

It appears that the difference in the color of the object results in the difference of about 20 mm in the detection distance and unnecessary detection may be performed. However, the test has been conducted using a delustered black and a bright white. Thus, the difference is smaller in the actual operation than in the testing, and the actual operation can be performed satisfactorily.

Figure 6:
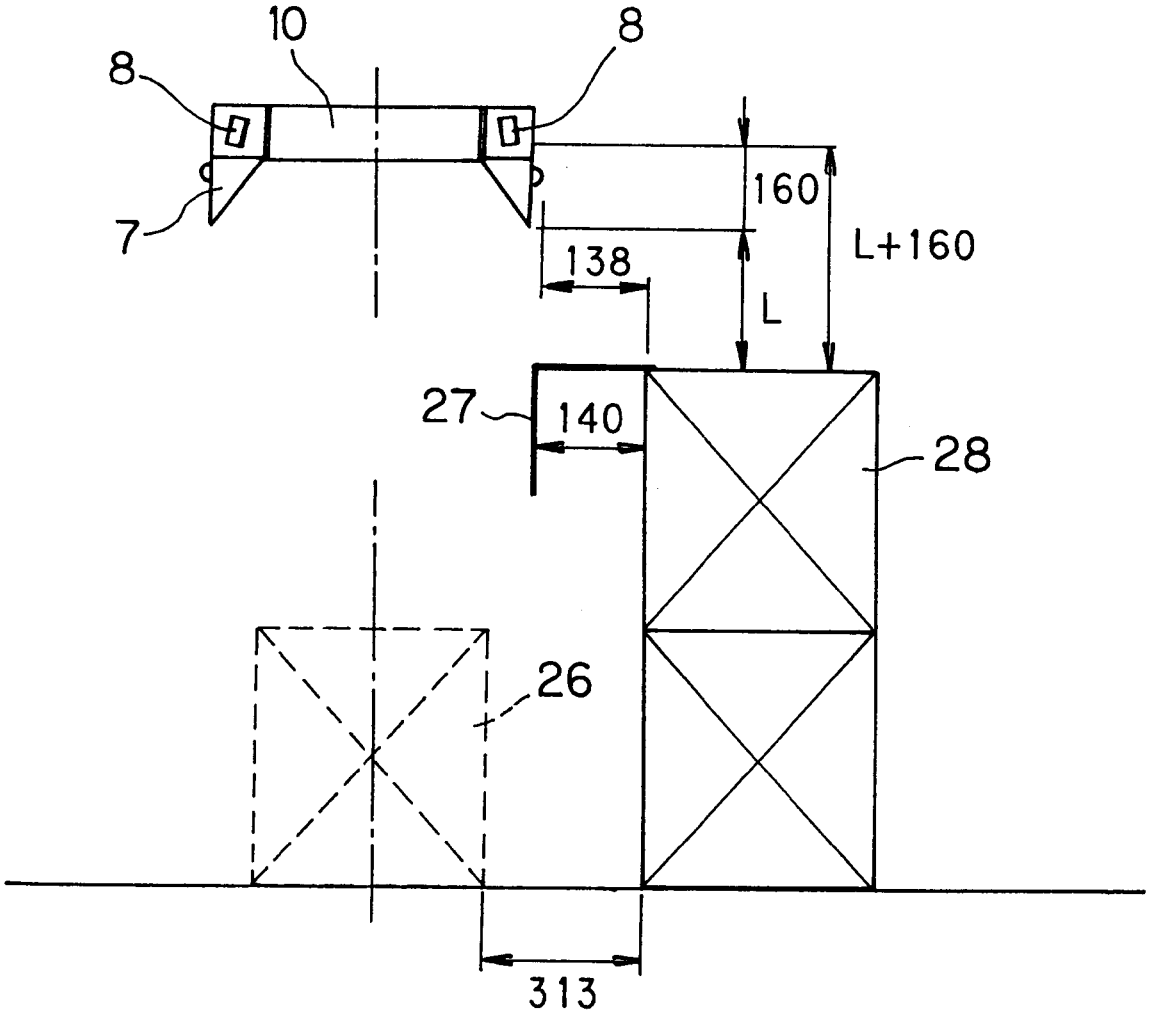
FIG. 6 is an explanation drawing of a test using an in-house crane with a built-in lowering collision avoidance device related to the embodiment of the invention.

The function of the lowering collision avoidance device was tested on an in-house crane as shown in FIG. 6

The testing conditions were as follows:

Hoisting accessory: Normal position Vertically lowered into a canyon

Object: Container, or dummy container in the form of a container end portion (molded boxboard)

Color of dummy container: Black or white

In FIG. 6, the thick line represents a dummy container end portion 27 molded from a boxboard. The distance between an imaginary container 26 and an adjacent container 28 was set at 313 mm, and a hoisting accessory 10 was lowered vertically onto the imaginary container 26 at a normal position. The dimensions of each part are as illustrated. Test was conducted with lowering being performed from a position apart from a target position by the remaining lowering distance to the target position, i.e., the distance L between the lower end of the stacking guide and the top of the adjacent container 28, L being 5 to 10 m.

When the dummy container end 27 was not attached to the adjacent container 28, the hoisting accessory 10 was lowered into the canyon successfully without being decelerated. This means that the container detector 8 remained OFF as expected.

When the dummy container end 27 was attached to the adjacent container 28, the function of the container detector 8 and a collision avoidance logic were confirmed as follows:

(1) Black container; At low speed

The container detector 8 became ON, and the hoisting accessory 10 stopped in the normal stop mode. This means that the collision avoidance logic recognized that the remaining distance between the lower end of the stacking guide and the top of the adjacent container was sufficient for a normal stop, and acted as expected.

(2) Black container; At high speed

The container detector 8 became ON, and an emergency stop worked. This means that the collision avoidance logic recognized that the remaining distance between the lower end of the stacking guide and the top of the adjacent container was insufficient for a normal stop, and acted as expected.

(3) White container; At high speed

The container detector 8 became ON, and an emergency stop worked. This means that the collision avoidance logic recognized that the remaining distance between the lower end of the stacking guide and the top of the adjacent container was insufficient for a normal stop, and an emergency stop acted.

With the white container, the container detector 8 became ON at a higher position than with the black container. This is because the container detector 8 is more sensitive to the white container than to the black container, as the detection characteristics of the container detector 8 have demonstrated. Thus, the range of height in which the container detector 8 becomes active is set by the controller so that the container detector 8 does not unnecessarily detect the adjacent container if it is a bright-colored container.

From the point of view of operating safety, the conditions for the container detector 8 should be set based on a black container. This is because the color of an actual container is brighter than the block surface of the container used in the test, and the use of a black container as a basis in the setting would enable the actual container to be detected without fail.

The lowering collision avoidance device according to the present invention functions satisfactorily when installed on a commercial machine. Thus, its effectiveness has been demonstrated.

As concretely explained above along with the embodiment, the lowering collision avoidance device of a crane as the first aspect of the invention does not stop the lowering of the carried article unconditionally when the obstacle detecting device detects an obstacle. Instead, the lowering collision avoidance device controls the hoisting/lowering drive motor, thereby controlling the lowering speed of the carried article, in such a manner that when the obstacle detecting device becomes ON, a lowering stop action is performed to start decreasing the lowering speed at a predetermined rate; even during this period, the remaining lowering distance and a normal stopping distance are computed; and when the obstacle detecting device becomes OFF for a predetermined duration, and after a judgment is made that the risk of collision of the lowered carried article with the obstacle has vanished, lowering is resumed if the remaining lowering distance is larger than the normal stopping distance, or an emergency stop action is performed if the remaining lowering distance is not larger than the normal stopping distance. Hence, maximum continued operation can be carried out to the extent that the lowered carried article will not collide with the obstacle. In case a real risk of collision exists, the lowering of the carried article can be stopped. Thus, the cycle time can be shortened safety.

According to the lowering collision avoidance device of a crane as the second aspect of the invention, when the obstacle detecting device becomes OFF for one period of swing computed from the rope length detected by the rope length detecting device, a judgment is made that the risk of collision of the lowered carried article with the obstacle has vanished. Thus, such a judgment can be made more properly.

We claim:

1. A lowering collision avoidance device for a crane, comprising:

a hoisting/lowering device including a hoisting/lowering drive motor, and further including a rope depending from said hoisting/lowering device, with said rope capable of being taken up or paid out by said hoisting/lowering drive motor;

a hoisting accessory suspended from said rope, with said hoisting accessory capable of being attached to an article to be lowered;

an obstacle detector for detecting an obstacle below or to a side of said hoisting accessory and said article, with said obstacle detector positioned on said hoisting accessory;

a speed detector capable of detecting a lowering speed of said hoisting/lowering device;

a distance detector for determining a total height from said hoisting/lowering device to a surface beneath said hoisting accessory and said article;

a rope length detector for determining a rope length of said rope paid out by said hoisting/lowering device; and a controller capable of receiving inputs from said obstacle detector, said speed detector, said rope length detector, and said distance detector, with said controller capable of computing a swing period of said hoisting accessory by using said rope length, with said controller further capable of decreasing said lowering speed of said hoisting/lowering device when an obstacle is detected by said obstacle detector below or to a side of said hoisting accessory during any portion of a swinging motion of said hoisting accessory and said article.

2. The lowering collision avoidance device of a crane as recited in claim 1, wherein when said obstacle detector becomes OFF for one period of swing computed from the rope length detected by said rope length detector, said controller judges that the risk of collision of the lowered carried article with the obstacle has vanished.

3. The device of claim 1, wherein said obstacle detect is angled outward from said hoisting accessory.

4. The device of claim 3, wherein said obstacle detector is positioned at an angle of about two and one quarter degrees from vertical.

5. The device of claim 1, wherein said obstacle detector is capable of detecting said obstacle when said obstacle is within about one and sixteen hundredths of a meter.

6. The device of claim 1, wherein said obstacle detector is positioned on said hoisting accessory at a location corresponding to an upper corner of said article to be lowered.

7. The device of claim 1, wherein said obstacle detector is positioned on said hoisting accessory at a location corresponding to a lower corner of said article to be lowered.

8. The device of claim 1, wherein said obstacle detector is a photoelectric sensor.

9. The device of claim 8, wherein said obstacle detector both emits light and detects reflected emitted light.

10. The device of claim 1, wherein said hoisting accessory further includes a stacking guide which extends to the bottom of said article to be lowered and includes inclined faces on said stacking guide which guide said article to be lowered into position on top of a second article positioned beneath said article to be lowered.

11. A collision avoidance method for lowering a swinging article from a crane, comprising the steps of:

determining a rope length of a rope extending between a hoisting/lowering device of said crane and a hoisting accessory of said crane, with said hoisting accessory capable of being attached to an article to be lowered;

determining a lowering speed of said hoisting/lowering device;

determining a swing period of said hoisting accessory from said rope length;

detecting an obstacle during a swing of said hoisting accessory if said obstacle is within a pre determined distance from said hoisting aeccessory;

decreasing said lowering speed to a predetermined slow lowering speed if said obstacle is detected;

resuming said lowering speed if at said slow lowering speed and if said obstacle detector does not again detect said obstacle within said swing period;

calculating a remaining height of said hoisting accessory using a distance detector and said rope length if said obstacle detector continues to detect an obstacle within said predetermined distance; and lowering said article based on said remaining height.

12. The method of claim 11, wherein the lowering step further includes stopping said lowering when a limit switch on said hoisting accessory contacts a surface beneath said hoisting accessory, indicating that said lowering is complete.

13. The method of claim 11, wherein the detecting step further includes detecting an obstacle within said predetermined distance during any portion of a swinging motion of said hoisting accessory and said carried article.

* * * * *